United States Patent [19]

Allen

[11] 4,199,280

[45] Apr. 22, 1980

[54] EQUIPMENT FOR INSTALLING INSULATION

[76] Inventor: Lee R. Allen, Applegarth Rd., Hightstown, N.J. 08520

[21] Appl. No.: 927,247

[22] Filed: Jul. 21, 1978

[51] Int. Cl.[2] ..... B65G 53/48

[52] U.S. Cl. ..... 406/56; 222/271

[58] Field of Search ..... 302/2 A, 36, 40, 42, 302/50; 222/236, 241, 271; 406/53, 56, 61

[56] References Cited

U.S. PATENT DOCUMENTS

| | | | |
|---|---|---|---|
| 1,202,088 | 10/1916 | Murray . | |
| 1,563,206 | 11/1925 | Longenecker | 302/50 |
| 1,726,812 | 9/1929 | Eggert | 222/271 X |
| 1,835,989 | 12/1931 | Hofft et al. | 222/271 |
| 2,532,318 | 12/1950 | Mackey et al. . | |
| 2,532,351 | 12/1950 | Wedebrock . | |
| 2,614,892 | 10/1952 | Cherewick . | |
| 2,621,083 | 12/1952 | Daniels . | |
| 2,872,166 | 2/1959 | Roberts . | |
| 3,175,866 | 3/1965 | Nichol | 302/36 |
| 3,428,196 | 2/1969 | Eaves | 222/271 X |
| 3,679,082 | 7/1972 | Grablich . | |

*Primary Examiner*—Jeffrey V. Nase

*Attorney, Agent, or Firm*—John J. Kane; Frederick A. Zoda; Albert Sperry

[57] ABSTRACT

Equipment for blowing insulation or the like into buildings or other areas is provided with a supply bin or hopper having a primary conveyor, such as a plurality of parallel screw conveyors, occupying substantially the entire area of the bottom of the bin and serving to supply the insulation to a feed conveyor for transfer to a discharge tube, the delivery conveyor in the discharge tube preferably also is in the form of a screw conveyor which advances the insulation to an air blowing source that discharges into the insulation flow path to blow the insulation through a distributing hose in a controlled manner for placement in a desired area, the operation of the primary conveyor, feed conveyor and delivery conveyor as well as the operation of the air blower are responsive to a separate controller being remotely locatable with respect to the hopper so that a single operator may vary the supply of insulation material and air as required simultaneously with manipulating the distributing hose to assure proper placement of the insulation is desired.

8 Claims, 2 Drawing Figures

EQUIPMENT FOR INSTALLING INSULATION

BACKGROUND OF THE INVENTION

1. Field of the Invention

It is common practice today to apply thermal insulation in the form of loose fibers or pellets to the walls, ceilings or other area and spaces in buildings by blowing the insulation through a hose or pipe which is manipulated by an operator. The insulation is usually supplied from a bin or hopper located outside the building or elsewhere at a convenient location.

2. Description of the Prior Art

Typical equipment heretofore used for these purposes are disclosed in U.S. Pat. Nos. 1,202,088; 2,532,318; 2,532,351; 2,614,892 and 2,621,083.

These present embodiments of such insulation blowing equipment have proved unsatisfactory in operation by reason of the irregular flow or supply of the material to the blowing device since the bin into which it is fed is usually relatively small and it is necessary for an operator to frequently replenish the supply or use a second person to maintain the supply in the bin. On the other hand if a large bin is provided the loose material often hangs up on the walls of the bin and does not flow in a continuous and orderly manner to the blowing device. It has therefore been required for one operator to tend to the supply and feeding of material while another operator handles the hose by which the loose material is distributed and discharged into place. The requirement of two operators has proven to be unduly expensive in labor costs and therefore a need has arisen for equipment usable to blow in insulation wherein all operating characteristics are controlled by the single person handling the distributing hose.

SUMMARY OF THE INVENTION

In accordance with the present invention the insulation to be delivered may be charged into a chamber having sufficient capacity to complete the insulation of an entire building, wall or unit of the construction to be insulated. The bottom of the bin or chamber is substantially occupied completely by a primary conveying means which serves to remove the insulation in such a way as to prevent bridging or cavitation of the material or packing or clinging of the material to side walls of the chamber. Continuous movement of the insulation from the bin to a feed conveyor serves to assure a continuous and uniform supply thereof to a delivery conveyor for movement to the blowing means whereby irregularity in flow of insulation is avoided.

The construction further is provided with control means which may be remotely locatable adjacent the end of the distributing hose for starting, stopping, or varying the operation of the feed and blower so that a single operator can manipulate the distributing hose and at the same time control the delivery of insulation material and air thereto in a manner to assure the most effective and easy distribution of the insulation to the desired locations and to further facilitate cleaning of the hoses.

The provision of conveying means occupying substantially the entire area at the bottom of the supply bin, as, for example, by employing a plurality of parallel screw conveyors, serves to permit movement of the insulation downward throughout a large bin without requiring an operator to recharge or to shift the loose material about to overcome irregular downward flow. Since at least a part of the conveying means will be moving material to the feed conveyor at all times during operation thereof the combination serves to assure an uninterrupted supply and movement of the loose insulation to the feed conveyor, despite any irregular flow of material from one or less than all of the screw conveyors at the bottom of the bin. The feed conveyor then passes the loose material in a continuous and uniform manner to the discharge tube and the delivery conveyor for delivery to the blower and distributing hose and nozzle. Clogging and overloading of the equipment and its delivery hose and the occurance of stoppages and irregular feed of the insulation is thereby avoided. As a result the operator can place the insulation in the desired location more readily and uniformly.

Further by locating motor controls for the various conveyors and blower adjacent the hose and its nozzle, a single operator can handle the entire operation more effectively and easily.

It is an object of the equipment for blowing insulation of the present invention to provide an apparatus for applying insulation to large areas without requiring reloading of the insulation supply bin.

It is an object of the present invention to provide an equipment for blowing insulation which is efficient in operation and simple in construction.

It is an object of the present invention to provide equipment for blowing insulation which prevents bridging of the insulation within the insulation supply bin.

It is an object of the present invention to provide an equipment for blowing insulation wherein a plurality of screw conveyors occupy substantially the entire bottom area of the supply bin.

It is an object of the present invention to provide an equipment for blowing insulation which includes full control of all operating motors and controls at the application end of the insulation distributing hose.

It is an object of the present invention to provide an equipment for blowing insulation which is completely usable by a single operator holding the distributing hose.

It is an object of the present invention to provide an equipment for blowing insulation including a narrowing restriction means within the discharge tube thereof to increase the flow of insulation and the application of insulation through the distributing hose and to facilitate cleaning of the distributing hose.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings in which:

DETAILED DESCRIPTION OF THE PREFERRED EMBODIMENT

Figure 1:
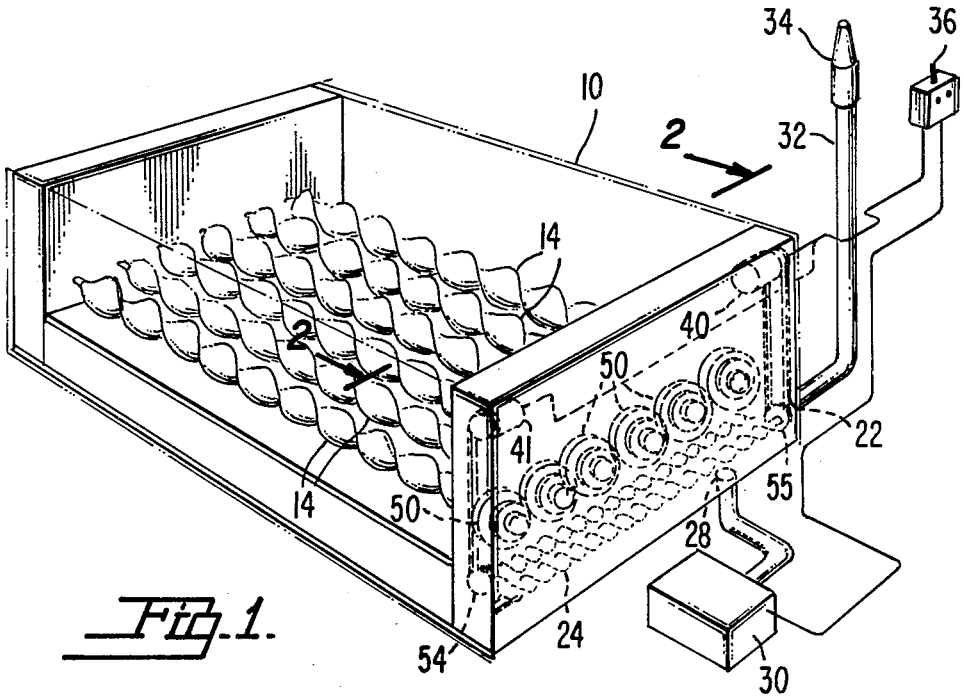
FIG. 1 is a diagrammatic illustration in perspective of a typical embodiment of the equipment of the present invention.
Figure 2:
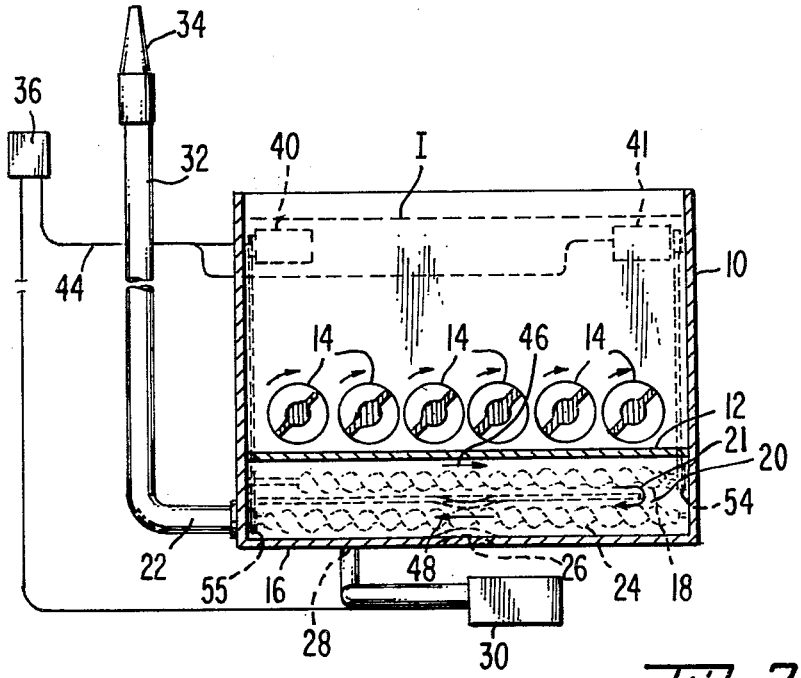
FIG. 2 is a longitudinal cross-sectional view through FIG. 1 along lines 2-2.

In that form of the invention chosen for illustration in the drawings the equipment embodies a supply bin or hopper 10 which preferably has substantially vertical sidewalls and may be of sufficient capacity to contain enough of the loose insulation materials to fill the entire space or area to be insulated. The supply bin 10 should include a substantially horizontal bottom area 12 which is almost entirely covered by a primary conveying means 14 such as a screw conveyor. The multiple screw conveyor elements as shown in FIGS. 1 and 2 will carry insulation located within the bin 10 to a trough 16 located at the downstream end of each of the individual screw conveyors 14. The trough 16 thereby serves to gather the insulation carried by the primary conveyor.

Positioned within trough 16 is a feed conveying means or feed screw conveyor 18 which serves to carry the gathered insulation in the direction shown by arrow 46 to the delivery inlet 20. Delivery inlet 20 accepts the insulation carried by the screw conveyor 18 whereby the insulation is carried into the discharge tube 22 as shown passing through delivery inlet 20 by arrow 21.

A delivery conveying means or screw conveyor 24 is located within the discharge 22 and is adapted to carry the insulation in the direction shown by arrow 48 for placement in the desired locations. Delivery conveying means 24 causes the insulation to move through the discharge tube toward a distributing hose 32 for placement. In order to facilitate flow of insulation a blower source 30 is connected at a blower inlet 28 into the discharge tube 22. This supply of pressurized air or other gas will allow the insulation to be blown through the distributing hose and into the wall or ceiling area as desired. In order to facilitate this blowing of insulation a constriction means 26 may be configured in the discharge tube 22 to make use of the Venturi effect to increase the pressure of blown insulation. Primarily, however, the constriction means 26 prevents blow back in a rearward direction through the system and as such concentrates the flow of pressurized air downstream through the discharge tube 22. Furthermore, during cleaning the constriction means 26 will also prevent blowback and facilitate the purging of distributing tube 22.

In order to help guide the flow of blown insulation a distributing nozzle 34 may be configured on the end of distributing hose 32. Also a control means 36 should be placeable adjacent the distributing hose 32. This control means should be operable to control the actuation of the drive means 40. The control is maintained through control lines 44. By allowing positioning of the control means 36 adjacent the distributing hose 32 and particularly in the neighborhood of the distributing nozzle 34, a single individual who is already required in order to guide the end of the distributing hose can control the entire operation via this control means 36. Heretofore, this system required two individuals, one to maintain the proper controlling of the various drive means and to keep the supply bin 10 full of insulation and another to distribute the insulation via the hose. Now by careful choice of the structure of the supply bin and by the utilization of a control means 36 positionable adjacent the end of the distributing hose 32 a single person can achieve full control. The supply bin can be made of a large capacity and yet will not allow bridging and other restrictions to the flow of insulation since the entire bottom area of the bin is indeed horizontal and the entire bottom area is covered by the primary screw conveying means 14.

Conveying means 14 will comprise essentially a plurality of augers each having a sprocket 50 located at the end thereof. These sprockets 50 are interconnected by a chain drive to transfer drive thereto. The chain can be driven by any conventional means powered from drive means 41. Drive means 41 may be operably connected by chain to sprocket 55 to drive feed conveyor 18 and, also, through gear reducer 60 to drive the conveyors 14. Similarly the delivery conveyor may be interconnected at the end thereof by interlocking sprocket 54 to drive means 40. In order to achieve full operational control the control means 36 should also include an electrical control means for the air blower source 30.

While particular embodiments of this invention have been shown in the drawings and described above, it will be apparent, that many changes may be made in the form, arrangement, and pasitioning of the various elements of the combination. In consideration thereof it should be understood that preferred embodiments of this invention disclosed herein are intended to be illustrative only and not intended to limit the scope of the invention.

I claim:

1. Equipment for blowing loose insulation or the like into desired locations comprising:

(a) a supply bin for holding therein the insulation material to be delivered;

(b) a primary conveying means occupying substantially the entire area at the bottom of said supply bin;

(c) a feed conveyor extending transversely with respect to said primary conveying means to receive loose insulation material from said primary conveying means;

(d) a discharge tube defining a delivery inlet adjacent said feed conveyor to receive insulation material therethrough, said discharge tube including a constriction means therein to narrow the the cross-sectional flow path of insulation therethrough;

(e) a delivery conveyor positioned within said discharge tube and adapted to convey insulation from said delivery inlet;

(f) a distributing hose connected to said delivery conveyor to receive insulation therefrom for blowing into desired locations;

(g) air blower means connected to said discharge tube downstream of said constriction means to supply pressurized air thereto to cause blowing of the insulation through said distributing hose; and (h) control means remotely locateable near said distributing hose to selectively control the actuation of said primary conveying means, said feed conveyor means, said delivery means, and said air blower means.

2. The equipment as defined in claim 1 further including drive means for driving said feed conveyor, said delivery conveyor and said primary conveying means.

3. The equipment as defined in claim 1 wherein said supply bin includes a substantially horizontal bottom area completely covered by said primary conveying means.

4. The equipment as defined in claim 1 further comprising a distributing nozzle at the end of said distributing hose to control the application of insulation to the desired location.

5. The equipment as defined in claim 1 wherein said primary conveying means comprises a primary screw conveyor.

6. The equipment as defined in claim 1 wherein said feed conveying means comprises a feed screw conveyor.

7. The equipment as defined in claim 1 wherein the delivery conveyor means comprises a delivery screw conveyor.

8. Equipment for blowing loose insulation or the like into desired locations comprising:

(a) a supply bin for holding therein the insulation material to be delivered, said supply bin including a substantially horizontal floor area to prevent the bridging of insulation material therein;

(b) a primary screw conveying means occupying substantially the entire bottom area of said supply bin;

(c) a feed screw conveying means extending transversely with respect to said primary conveying means to receive loose insulation material from said primary conveying means;

(d) a discharge tube defining a delivery inlet adjacent said feed conveying means to receive insulation material therethrough;

(e) a delivery screw conveying means positioned within said discharge tube and adapted to convey insulation from said delivery inlet;

(f) a flexible distributing hose connected to said delivery conveying means to receive insulation therefrom for blowing into desired locations;

(g) a constriction in said discharge tube to narrow the cross-sectional flow area of insulation being carried through said discharge tube by said delivery screw conveying means;

(h) air blower means connected to said discharge tube downstream from said constriction means to supply pressurized air to cause blowing of the insulation through said distributing hose; and (i) control means remotely locateable near said distributing hose to selectively allow control of the actuation of said primary screw conveying means, said feed screw conveying means, said delivery screw conveying means and said air blower means by the same person controlling the distributing hose.

* * * * *